US005106047A

United States Patent [19]

Baer

[11] Patent Number: 5,106,047

[45] Date of Patent: Apr. 21, 1992

[54] DOCUMENT HANDLING STAND

[76] Inventor: Sharon M. Baer, 3325 E. Shelby St., Ontario, Calif. 91764

[21] Appl. No.: 692,700

[22] Filed: Apr. 29, 1991

[51] Int. Cl.[5] ..... A47B 97/04

[52] U.S. Cl. ..... 248/459; 211/49.1; 248/174

[58] Field of Search ..... 248/174, 459, 460, 152; 211/135, 132, 133, 49.1; 206/45.21, 45.19, 45.14; D19/91

[56] References Cited

U.S. PATENT DOCUMENTS

| | | | |
|---|---|---|---|
| D. 244,331 | 5/1977 | Woods | D19/91 X |
| D. 248,110 | 6/1978 | Wright | D19/91 X |
| 2,277,494 | 3/1942 | Loewenstein | 248/459 |
| 2,479,910 | 8/1949 | Davidson | 248/459 X |
| 3,375,935 | 4/1968 | Whyte | 211/135 |
| 3,494,479 | 2/1970 | Martin | 248/174 X |
| 3,990,598 | 11/1976 | Roeser | 248/174 X |
| 4,424,906 | 1/1984 | Richmond | 206/45.14 X |
| 4,753,341 | 6/1988 | McIntyre | 206/45.19 X |
| 4,781,355 | 11/1988 | Jeantin | 248/174 X |
| 4,962,859 | 10/1990 | Kump | 248/174 X |

FOREIGN PATENT DOCUMENTS

| | | | |
|---|---|---|---|
| 263983 | 1/1927 | United Kingdom | 248/174 |

OTHER PUBLICATIONS

Deflect-o Stand Brochure (3 pages).

Pp. 471–473 of Desk Organizers Catalog.

*Primary Examiner*—J. Franklin Foss

*Attorney, Agent, or Firm*—Harris, Kern, Wallen & Tinsley

[57] ABSTRACT

A stand for reception and distribution of documents and including a base, an upright support panel projecting upward from the base, a paper support ledge projecting outward from the panel, and the first and second wings at opposite sides of the panel and ledge defining a receptacle for documents. The stand may be made from a single sheet of material, or from a number of pieces, preferably a clear plastic. Preferably the panel and ledge are oblique to the base, and the panel has an open ended slot for access to documents resting on the panel and ledge. A tray for positioning under the base to provide a separate horizontal storage area for documents.

11 Claims, 3 Drawing Sheets

FIG. 1
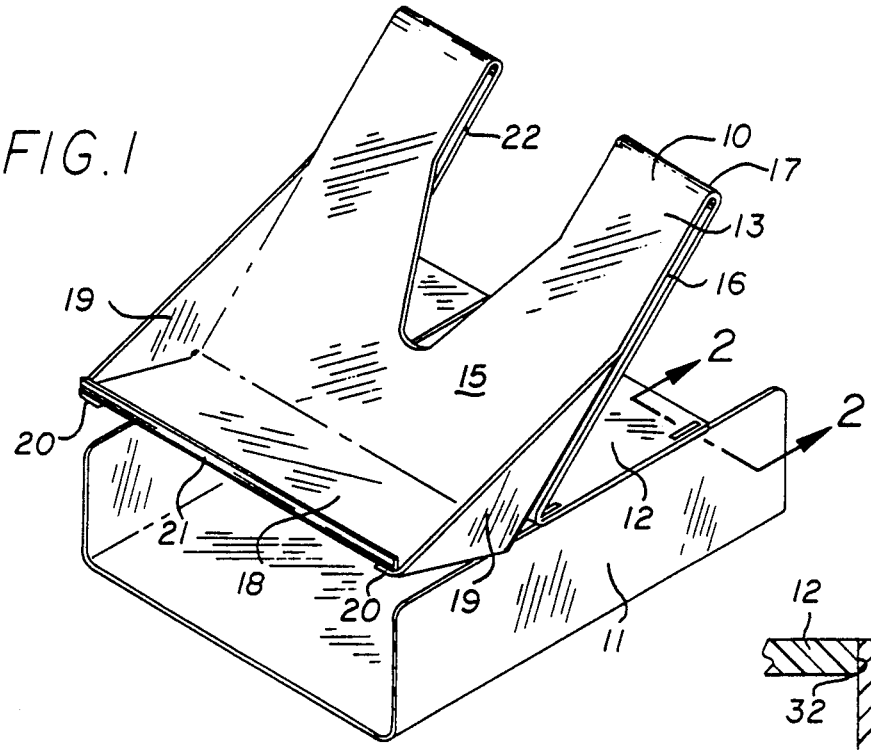
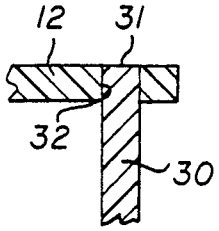
FIG. 2
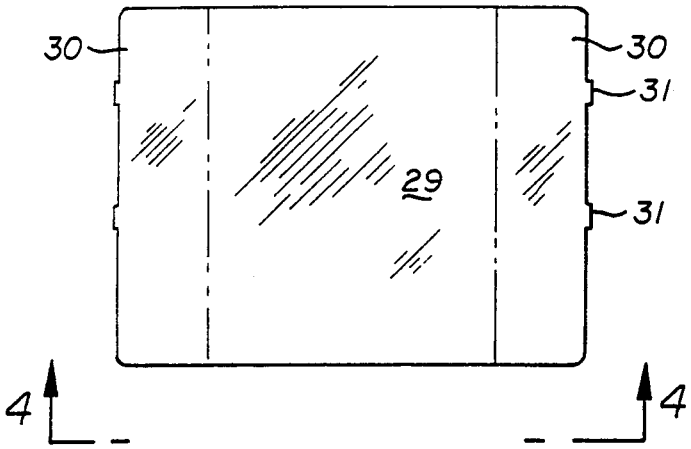
FIG. 3
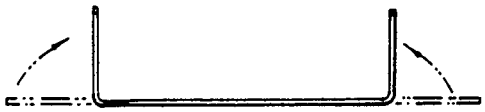
FIG. 4

FIG. 5
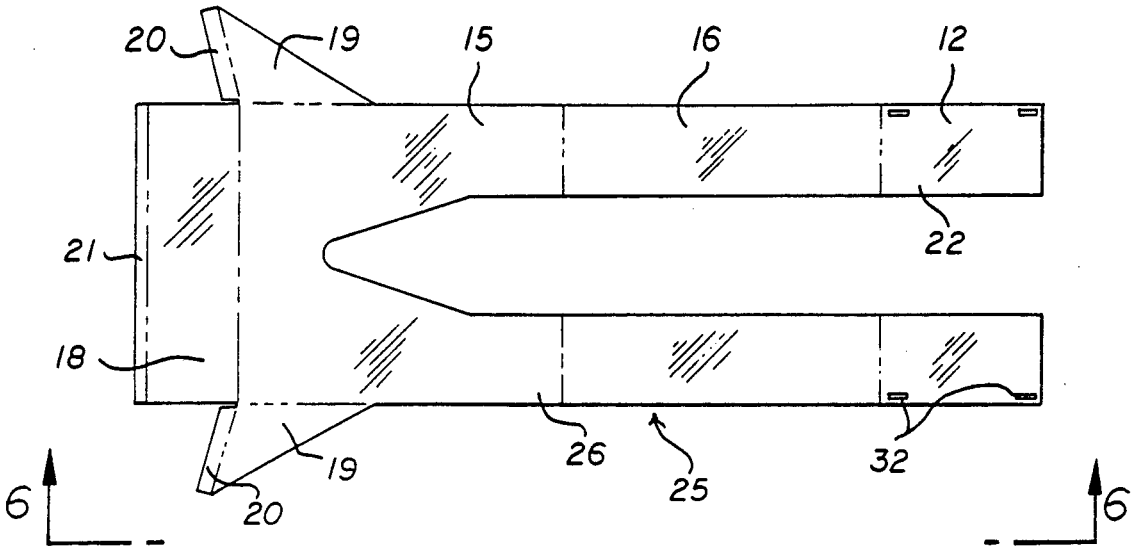
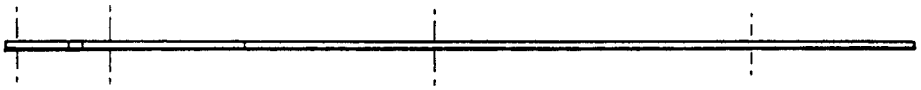
FIG. 6
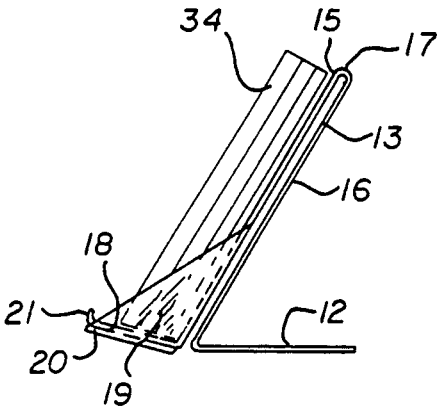
FIG. 7

DOCUMENT HANDLING STAND

BACKGROUND OF THE INVENTION

This invention relates to devices for handling documents at a work station. Even though computers are being used in ever increasing numbers, efficient handling of documents is still desirable, particularly since documents are the primary source of input information for a computer.

In the past documents typically are handled in stacks, with a document being added to the stack on the top and being removed from the top of the stack. Alternatively, the stack can be turned over to remove a document from the bottom of the stack. Copy stands have been used for supporting a document in an upright position at a typewriter or computer keyboard. Sometimes several documents are placed on such a support with the top document being removed one at a time to expose the next document in the stack during transcription.

It is an object of the present invention to provide a new and improved document handling stand which will provide for stacking of documents with new documents being added at the top of the stack and with old documents being removed from the bottom of the stack so that the documents can be handled in the sequence in which they are received without additional manipulation.

It is another object of the invention to provide such a stand which can be easily and inexpensively formed of clear plastic, so that the stand can have strength and durability while at the same time be relatively unobtrusive at a work station.

It is a further object of the invention to provide such a document handling stand which can be used free standing on a desk top or other surface or which can be used in combination with one or more trays, with the stand resting on a tray or trays and thereby providing for document storage under the stand in the tray.

Other objects, advantages, features, and results will more fully appear in the course of the following description.

SUMMARY OF THE INVENTION

A document handling stand for reception and distribution of documents with a base, an upright support panel projecting upward from the base, a paper support ledge projecting outward from the panel, and first and second wings at opposite sides of the panel and ledge defining a document receptacle. The stand may be formed from a single sheet of material, preferably a clear plastic, and may be made of a number of pieces glued or otherwise joined together.

In one embodiment, the upright panel is made as a double layer with the material folded on itself and with a slot on the panel open at the upper edge or foldline. The wings have tabs folded under the ledge in supporting relation, and a lip is formed at the outer edge of the ledge for aid in paper retention.

The stand is designed for resting directly on a work surface and for resting on a tray which supports the stand spaced above the work surface.

BRIEF DESCRIPTION OF THE DRAWINGS

FIG. 1 is a perspective view of a document handling stand incorporating one embodiment of the invention;

FIG. 2 is an enlarged partial sectional view taken along the line of 2—2;

FIG. 3 is a top plan view of the tray of FIG. 1 in the unfolded position;

FIG. 4 is side view taken along the line 4—4 of FIG. 3 showing the tray in the folded or finished position;

FIG. 5 is plan view of a sheet of material for the stand of FIG. 1, shown prior to folding;

FIG. 6 is a side view taken along the line 6—6 of FIG. 5;

FIG. 7 is a side view of the stand of FIG. 1 with a stack of documents on the stand;

DESCRIPTION OF THE PREFERRED EMBODIMENT

Figure 8:
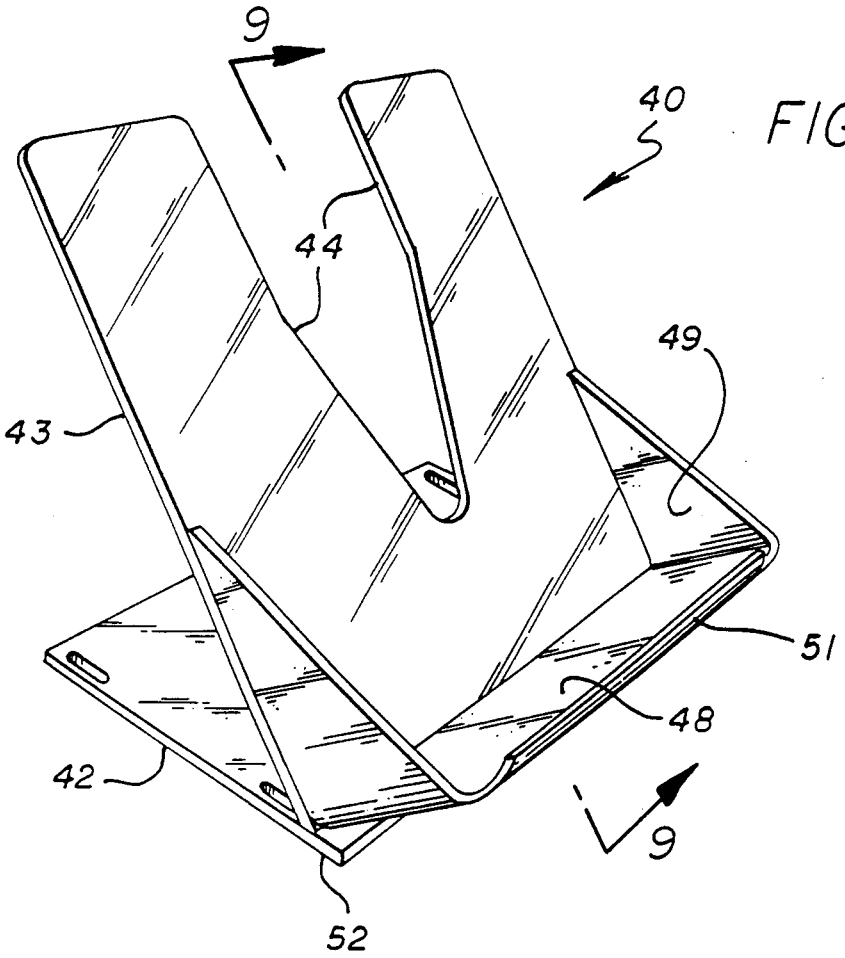
FIG. 8 is a view similar to that of FIG. 1 showing an alternative and presently preferred embodiment of the invention.

Referring to the drawings, a document handling stand 10 is shown in FIG. 1 mounted on a tray 11. The stand has a base 12 and a generally upright support panel 13 projecting upward from the base. In the embodiment illustrated, the support panel 13 includes a back panel 15 and a front panel 16 typically produced by folding the panel at a foldline 17. A paper support ledge 18 projects outward from the panel 13, with wings 19 positioned at opposite sides of the panel and ledge to define a document receptacle.

In the embodiment illustrated, tabs 20 on the wings 19 project under the ledge 18, and an upturned lip 21 is positioned at the outer edge of the ledge 18. A slot 22 is provided in the support panel 13, with the slot having an open end at the upper edge of the panel. The wings 19 may be formed integral with the panel 15 and ledge 18, or may be formed separately and then attached.

In the embodiment illustrated, the stand is formed from a single sheet of material 25, typically a sheet of transparent plastic. The sheet is cut to the shape as shown in FIG. 5 and then is folded along the foldlines 26 to the configuration of FIGS. 1 and 7. The tabs 20 may be fixed to the underside of the ledge 18 if desired, as by cementing or heat bonding. Alternatively the tabs can be left unsealed and may provide mechanical support for the ledge.

The tray 12 has a bottom 29 and sides 30 with tabs 31 formed at the outer edges of the sides for positioning in corresponding openings 32 in the base 12.

The tray may be manufactured in the same manner as the stand, from a single sheet of plastic which is cut to the shape of FIG. 3 and then folded to the configuration of FIG. 4. The mounting of the stand on the tray is shown in FIGS. 1 and 2. The stand can be fixed to the tray if desired, but preferably the two components are not permanently joined, so that the stand and the tray can each be used separately.

The stand is shown in use in FIG. 7 with a stack of documents 34 resting on the ledge against the support panel between the wings. Documents are added to the open top of the stack as they arrive at the work station. Documents may be removed from the bottom of the stack at the support panel by contacting the document through the slot and sliding it upward from the bottom of the stack. The unique stand permits handling of documents in the stack on a first in, first out basis without otherwise disturbing the stack or requiring any lifting or turning of the stack of documents.

Figure 9:
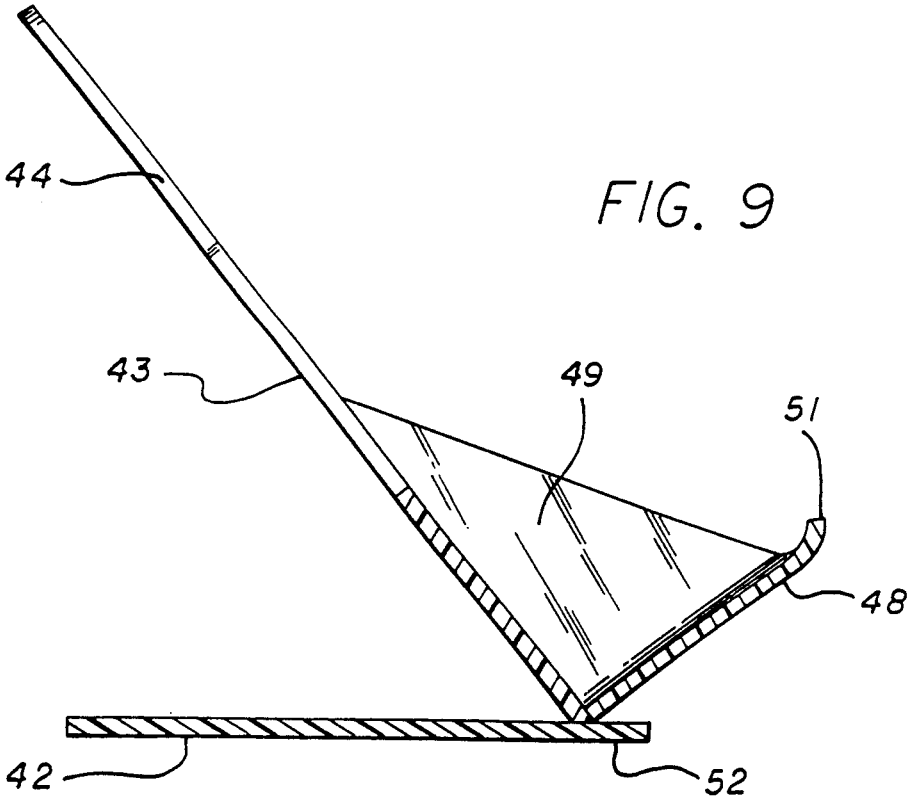
FIG. 9 is an enlarged sectional view taken along the line 9—9 of FIG. 8.

An alternative and presently preferred embodiment of the invention is shown in FIGS. 8 and 9. In this embodiment, the base 42, support panel 43 and ledge 48 are formed of separate elements glued together to provide the finished stand 40. The wings 49 of the ledge may be formed integral with the ledge or may also be made of separate pieces. The ledge may also have an upturned lip 51. The support panel 43 is a single layer, preferably with a slot 42 at the upper edge, similar to the slot 22 of the embodiment of FIG. 1.

Preferably, the ledge and the panel are joined together at the base at a position between the front and rear edges of the base, providing a lip 52 extending under the ledge for improved stability.

The stand of FIGS. 8 and 9 functions in the same manner as the stand of FIG. 1, and may be used with the tray 11 in the same manner. While the embodiment of FIGS. 8 and 9 uses several elements which are glued together, it has the advantage of requiring less material.

With the stand of the invention, items may be marked and placed at the rear of the stack to be brought forward for handling or checked, and then again placed in the stand to repeat the cycle at a later time. With this rotation arrangement, items are never left untouched.

I claim:

1. A document handling stand for reception and distribution of documents, comprising in combination:

a base;

an upright support panel projecting upward from said base and including means defining an open top slot in the upper edge of said panel, with said support panel tilting toward the user for supporting a stack of documents starting with one document directly on said panel and providing manual access to said one document through said slot for lifting said one document out of said stack of documents;

a paper support ledge projecting outward from said panel in a direction away from said user; and first and second wings at opposite sides of said panel and ledge directed away from said user and defining a document receptacle.

2. A stand as defined in claim 1 wherein said base, panel, ledge and wings are formed in a single unitary sheet of material.

3. A stand as defined in claim 1 wherein said panel is formed in two layers with one layer folded onto the other layer at a foldline, and with said base at one end and said ledge at the opposite end of said panel with said ends adjacent each other.

4. A stand as defined in claim 1 wherein each of said wings includes a tab folded under said ledge in supporting relation.

5. A stand as defined in claim 5 wherein said ledge includes an outer edge with an upturned lip.

6. A stand as defined in claim 5 wherein said base, panel, ledge and wings are formed in a unitary sheet of material.

7. A document handling stand for reception and distribution of documents, comprising in combination:

a base;

an upright support panel projecting upward from said base;

a paper support ledge projecting outward from said panel;

first and second wings at opposite sides of said panel and ledge defining a document receptacle;

with said panel formed in two layers with one layer folded onto the other layer at a foldline; and with said base at one end and said ledge at the opposite end of said panel with said ends adjacent each other;

means defining a slot in said panel, with said slot having an open end at said foldline, with each of said wings including a tab folded under said ledge in supporting relation, with said ledge including an outer edge with an upturned lip, with said panel and ledge each oblique to said base, and with said base, panel, ledge and wings formed in a unitary sheet of material; and a tray having a bottom and spaced sides, and with said base and sides including interengaging means for supporting said base on said sides and spaced upward from said bottom.

8. A stand as defined in claim 1 wherein said ledge includes an outer edge with an upturned lip.

9. A stand as defined in claim 8 wherein the lower edges of said panel and ledge are joined together at said base at a position between front and rear edges of said base.

10. A document handling stand for reception and distribution of documents, comprising in combination:

a base;

an upright support panel projecting upward from said base;

a paper support ledge projecting outward from said panel;

first and second wings at opposite sides of said panel and ledge defining a document receptacle;

means defining a slot in the upper edge of said panel;

with said ledge including an outer edge with an upturned lip, with said panel and ledge each oblique to said base, and with the lower edges of said panel and ledge joined together at said base at a position between front and rear edges of said base; and a tray having a bottom and spaced sides, and with said base and sides including interengaging means for supporting said base on said sides and spaced upward from said bottom.

11. A document handling stand for reception and distribution of documents, comprising in combination:

a base;

an upright support panel projecting upward from said base;

a paper support ledge projecting outward from said panel;

first and second wings at opposite sides of said panel and ledge defining a document receptacle; and a tray having a bottom and spaced sides, and with said base and sides including interengaging means for supporting said base on said sides and spaced upward from said bottom.

* * * * *